US005193899A

United States Patent [19]

Oe et al.

[11] Patent Number: 5,193,899

[45] Date of Patent: Mar. 16, 1993

[54] PLANAR LIGHT-SOURCE DEVICE AND ILLUMINATION APPARATUS USING THE SAME

[75] Inventors: Makoto Oe; Issei Chiba, both of Kawasaki, Japan

[73] Assignee: Mitsubishi Rayon Co., Ltd., Tokyo, Japan

[21] Appl. No.: 786,005

[22] Filed: Oct. 31, 1991

Related U.S. Application Data

[62] Division of Ser. No. 652,070, Feb. 7, 1991, Pat. No. 5,089,944, which is a division of Ser. No. 512,447, Apr. 23, 1990, Pat. No. 5,034,864.

[30] Foreign Application Priority Data

| | | | |
|---|---|---|---|
| Apr. 25, 1989 | [JP] | Japan | 1-105524 |
| Aug. 21, 1989 | [JP] | Japan | 1-213023 |
| Aug. 30, 1989 | [JP] | Japan | 1-221652 |
| Oct. 19, 1989 | [JP] | Japan | 1-270331 |
| Jan. 9, 1990 | [JP] | Japan | 2-964 |

[51] Int. Cl.[5] ..... F21V 5/02; F21V 13/04

[52] U.S. Cl. ..... 362/224; 362/260; 362/308; 362/331

[58] Field of Search ..... 362/223, 224, 244, 245, 362/246, 260, 296, 307, 308, 309, 310, 311, 327, 328, 339, 329, 331

[56] References Cited

U.S. PATENT DOCUMENTS

| | | | |
|---|---|---|---|
| 3,222,515 | 12/1965 | Orr | 362/331 |
| 3,288,990 | 11/1966 | Stahlhut | 362/331 |
| 3,866,036 | 2/1975 | Taltavull | 362/224 |
| 4,059,755 | 11/1977 | Brabson | 362/224 |
| 4,233,651 | 11/1980 | Fabbri | 362/223 |
| 4,242,723 | 12/1980 | Fabbri et al. | 362/331 |
| 4,642,736 | 2/1987 | Masuzawa et al. | 362/328 |
| 4,791,540 | 12/1988 | Dreyer, Jr. et al. | 362/309 |
| 4,874,228 | 10/1989 | Aho et al. | 362/327 |
| 4,876,633 | 10/1989 | Engel | 362/224 |
| 4,941,074 | 7/1990 | DeCosse et al. | 362/61 |

*Primary Examiner*—Richard R. Cole

*Attorney, Agent, or Firm*—Oblon, Spivak, McClelland, Maier & Neustadt

[57] ABSTRACT

A box-type planar light-source device has incorporated therein a linear light source and is provided with a reflecting surface and a multi-prism sheet. The reflecting surface has such function that a major portion of a light reflected by the reflecting surface is obliquely incident upon the multi-prism sheet. The multi-prism sheet has its inner surface formed with a group of prisms so arranged as to extend in parallel relation to the light source and having such function that the light incident directly or obliquely in reflection outgoes in concentration toward a predetermined direction. Accordingly, so as to eliminate portion by the fact that the light outgoing at an angle separated from the normal direction converges at the dark portion. A dark-portion removing sheet for eliminating a dark portion at a location immediately above the light source is arranged on the side of the front face of the multi-prism sheet. An illumination apparatus can satisfactorily exhibit its optical performance by incorporation of the planar light-source device as illumination apparatuses of various display devices. The display devices include an internal-illumination type display device, a liquid-crystal display device, a display device mounted to an automatic vending machine, an observation device for a film, or an illumination apparatus mounted to a wall surface of a building.

3 Claims, 15 Drawing Sheets

□: CASE B, +: CASE A, ◇: CASE C

□: CASE B, +: CASE A, ◇: CASE C

□: CASE B, +: CASE A, ◇: CASE C

□: CASE B, +: CASE A, ◇: CASE C

□: CASE B, +: CASE A, ◇: CASE C

□: CASE B, +: CASE A, ◇: CASE C

PLANAR LIGHT-SOURCE DEVICE AND ILLUMINATION APPARATUS USING THE SAME

This is a division of application Ser. No. 07/652,070 filed on Feb. 7, 1991, now U.S. Pat. No. 5,089,944, which is a division of application Ser. No. 07/512,447 filed on Apr. 23, 1990 now U.S. Pat. No. 5,034,864.

BACKGROUND OF THE INVENTION

The present invention relates to planar illumination devices and planar light-sources and, more particularly, to single-sided or double-sided planar light-source devices suitable for thin advertisement signboards, display units, planar illumination instruments or the like, and an illumination apparatus for illuminating various instruments such as liquid-crystal display instruments or the like having incorporated therein the planar light-source devices.

The main current of a particularly large advertisement signboard or illumination apparatus, which has conventionally been put into practical use, has such a construction that one or more fluorescent lamps are arranged within a housing, and a diffusion plate is arranged in spaced relation to the fluorescent lamps by a suitable distance. In such apparatus, however, if the distance between the fluorescent lamps and the diffusion plate is insufficient, emission lines of the fluorescent lamps called "lamp images" can be viewed, so that the depth of the apparatus must inevitably increase in order to secure uniformity of brightness. If the depth is decreased in such apparatus, diffusion performance of the diffusion plate cannot but increase. Since however, this causes a reduction in light-ray transmittance, the number of fluorescent lamps cannot but increase in order to maintain the same brightness. Thus, there arise such problems as countermeasures for an increase in consumptive electric power, a rise in temperature and so on.

In order to solve these problems, many proposals have conventionally been made (Japanese Utility Model Publication No. SHO 42-18278, Japanese Patent Provisional Publication No. SHO 55-15126, Japanese Patent Provisional Publication No. SHO 55-133008, Japanese Utility Model Provisional Publication No. SHO 55-35667 and Japanese Patent Provisional Publication No. SHO 59-22493). Since, however, these proposals are chiefly such that an upper portion immediately above a light source is shielded to cause the emission lines to disappear, uniformity is made in conformity with a portion dark in face. Thus, this is not preferable from the viewpoint of utilization efficiency of a quantity of light.

Further, as being thinkable in principle, it is adapted that approximation of a point source is used to arranged a lamp at a focus of a convex lens, and a light passing through the convex lens is brought to a parallel light, and it is possible to incorporate a Fresnel lens having such function in the light source. Since, however, the fluorescent lamp is not the point source, reproducibility of the principle is deteriorate so that it is the actual circumstances that the fluorescent lamp cannot be put to practical use.

SUMMARY OF THE INVENTION

In view of the above actual circumstances, the inventors of this application have recognized as being a phenomenon of a so-called "antinomy" in which an apparatus is reduced in thickness without a reduction in a surface luminance such that, if a linear light source like a fluorescent lamp approaches an illumination surface, emission lines appear and, if a shield element is used to dissolve such emission lines, luminance is reduced as a whole so that utilization efficiency of a quantity of light is reduced and, likewise, if an attempt is made at uniformity by the use of a diffusion plate high in diffusion performance, a surface is made dark. The inventors have earnestly considered achievement in reduction of thickness while effectively utilizing an optical energy emitted by a light source as far as possible. By the results of the earnest consideration, the inventors have found that the reduction in thickness has been achieved by control of a reflecting light and the use of a peculiar multi-prism sheet, and combination of a dark-portion removing sheet for removing a dark portion at a position immediately above the light source with the side of a front face of the multi-prism sheet. Thus, the inventors have completed this invention.

That is the invention has been done in order to achieve the above task, and is characterized by a box-type planar light-source device having incorporated therein a linear light source or a light source arranged linearly and provided, at its rear face, with a reflecting surface and, at its front face, with a multi-prism sheet, wherein said reflecting surface has such function that a major portion of a light reflected by said reflecting surface is obliquely incident upon said multi-prism sheet, wherein said multi-prism sheet has its inner surface formed with a group of prisms so arranged as to extend in parallel relation to the light source and having such function that the light incident directly or obliquely in reflection outgoes in concentration toward a predetermined direction, and wherein a dark-portion removing sheet for eliminating a dark portion at a location immediately above the light source is arranged on the side of the front face of said multi-prism sheet.

Further, the invention is characterized by a box-type planar light-source device having incorporated therein linear light sources or a plurality of light sources arranged linearly in parallel relation to each other and provided, at its rear face, with reflecting surfaces and, at its front face, with a multi-prism sheet, wherein each of said reflecting surfaces has such function that a major portion of a light reflected by the reflecting surface is obliquely incident upon said multi-prism sheet, wherein said multi-prism sheet has its inner surface formed with a group of prisms so arranged as to extend in parallel relation to the light source and having such function that the light incident directly or obliquely in reflection outgoes in concentration toward a predetermined direction, wherein the reflecting surfaces between said light sources are contiguous to each other with an inclination in accordance with a location between said light sources, wherein a top of a ridgeline between the reflecting surfaces is so constructed as to be located above a bottom of the light sources and below tops of the light sources, and wherein a dark-portion removing sheet for eliminating a dark portion at a location immediately above the light sources is arranged on the side of the front face of said multi-prism sheet.

Furthermore, the invention is characterized by a box-type planar light-source device capable of illuminating both sides, which has incorporated therein a linear light source or a light source arranged linearly and which is provided, at its opposite front and rear faces, with respective multi-prism sheets and, at its both side surfaces, with respective reflecting surfaces, wherein said reflecting surfaces have their generally wedge-like cross-section in which their forward sharp ends are oriented toward the light source, and said reflecting surfaces are so arranged as to extend in parallel relation to said light source, wherein each of said reflecting surfaces has such function that major portions of lights reflected respectively by a front-face side portion and a rear-face side portion of the reflecting surface are obliquely incident upon said multi-prism sheets on said front-face side and said rear-face side, wherein said multi-prism sheets have their inner surfaces formed respectively with groups of prisms so arranged as to extend in parallel relation to the light source and having such function that the light incident directly or obliquely in reflection outgoes in concentration toward a predetermined direction, and wherein a dark-portion removing sheet for eliminating a dark portion at a location immediately above the light source is arranged on the side of an outer surface of said multi-prism sheet.

Moreover the invention is characterized in that an illumination apparatus which can satisfactorily exhibit its optical performance by incorporation of said planar light-source device as illumination apparatuses of various display devices and, more particularly, is characterized by an internal-illumination type display device, a liquid-crystal display device, a display device mounted to an automatic vending machine, an observation device for a film or the like such as a illuminated photo display case (schaukasten), or an illumination apparatus mounted to a wall surface of a building.

BRIEF DESCRIPTION OF THE DRAWINGS

FIG. 30 is a fragmentary cross-sectional perspective view showing an example of the illumination apparatus in which the invention is used as an observation device for a film or the like.

DESCRIPTION OF THE EMBODIMENTS

Embodiments of the invention will be described below with reference to the drawings.

Figure 1:
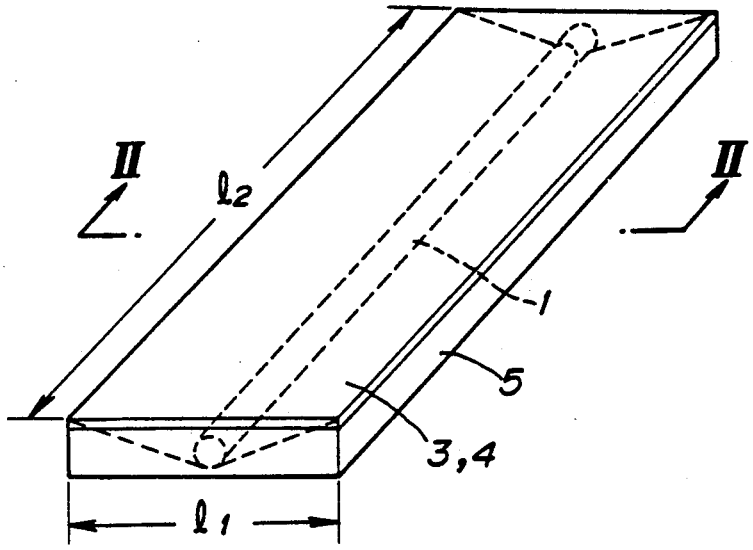
FIG. 1 is a perspective view showing an embodiment of the invention.
Figure 2:
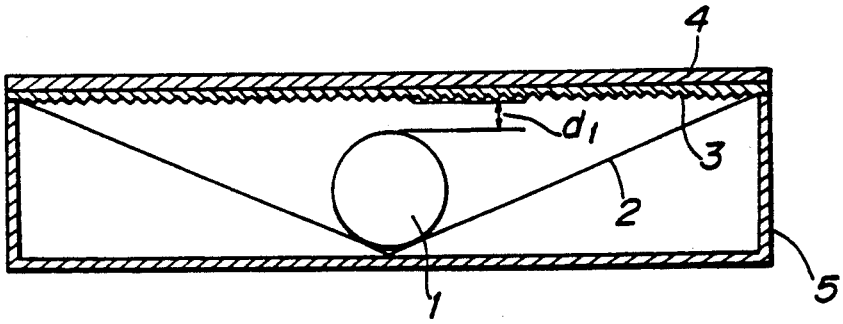
FIG. 2 is an enlarged cross-sectional view taken along the line II—II in FIG. 1.

First Embodiment: Embodiment in which a reflecting surface is composed of planar surfaces FIG. 1 shows an external appearance of an embodiment of the invention. FIG. 2 is a cross-sectional view taken along the line II—II in FIG. 1. In the drawings, the reference numeral 1 denotes a light source; 2, a reflecting surface; 3, a multi-prism sheet; 4, a dark-portion removing sheet; and 5, a housing.

Figure 3:
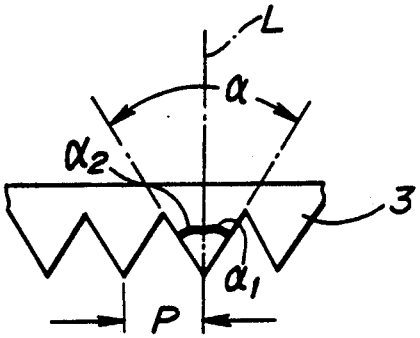
FIG. 3 is a fragmentary enlarged view of a multi-prism sheet.

In this embodiment, used as the light source 1 was a fluorescent lamp "FL-10W" (AC 100V, 10 W, 25 mm) manufactured by TOSHIBA CO., LTD. Used as the reflecting surface 2 was an element in which a silver-vacuumde-position polyester film having its thickness of 25 micorns was laminated onto a surface of an aluminum sheet having its thickness of 0.5 mm. The multi-prism sheet 3 used a colorless and transparent acrylic resinous plate (thickness: 1 mm), and was obtained such that the acrylic resinous plate was heat-pressed together with a mold. As shown in FIG. 3, the multi-prism sheet 3 was used in which a group of prisms having generally their configuration of regular triangle, whose pitch P was 0.38 mm, whose prism angle $a_1$ and $a_2$ were both 31.5° and whose head vertex angle a was 63°, were arranged so as to extend in parallel relation to each other. Further, the dark-portion removing sheet 4 used various synthetic resinous translucent plates (thickness: 2 mm and 1 mm), subsequently to be described. The housing 5 was assembled into a box configuration by the use of a synthetic resinous plate. Dimensions of the device at this time were such that $l_1$ was 150 mm which was six times the diameter of the fluorescent lamp, $l_2$ was 350 mm, and a gap $d_1$ between the fluorescent lamp and an opening surface of the housing 5 was 5 mm.

(1) Measurement of Luminance Distribution as Light Box

Of the devices constructed as described above, in order to grasp the quantity of light of the housing provided with the light source and the reflecting surface, the multi-prism sheet 3 and the dark-portion removing sheet 4 illustrated in FIG. 2 were first removed, and a colorless transparent acrylic resinous plate having its thickness of 3 mm rested in place of the multi-prism sheet 3 and the dark-portion removing sheet 4, to form a light box (hereafter the light box was used for convenience of experiments). Luminance on this surface was measured at points divided equally at intervals of 10 mm in a direction of the length $l_1$ at the center of the light box in a direction of $l_2$. In this connection, the measurement of the luminance was conducted in which a luminance meter of nt-1 manufactured by MINOLTA CO., LTD was used at a view field angle of 1° and at a spot diameter of 7 mmo. The results were as shown in the table 1, and there are twenty (20) times or more in a maximum difference between brightness and darkness.

TABLE 1

| MEASURING POINT | LUMINANCE (cd/m²) |
|---|---|
| 1 | 500 |
| 2 | 900 |
| 3 | 1,000 |
| 4 | 1,000 |
| 5 | 1,000 |
| 6 | 9,100 |
| 7 | 9,200 |
| 8 | 10,900 |
| 9 | 9,300 |
| 10 | 9,200 |
| 11 | 1,000 |
| 12 | 1,000 |
| 13 | 1,000 |
| 14 | 1,300 |
| 15 | 1,200 |

(2) Measurement of Luminance of Multi-prism Sheet

The group of prisms constructed according to the invention rested on the light box such that the group of prisms were oriented toward the light source, and the luminance of fifteen (15) points on the planar surface of the multi-prism sheet was measured in a similar method. The results of the measurement were shown in the table 2. It was known that, although a stripe-like dark portion (width: approximately 20 mm) was formed at the center corresponding to a location immediately above the luminescent lamp, locations having their luminance extremely low disappeared, and a ratio between brightness and darkness was 3.75 or less so that the multi-prism sheet could be used depending upon the use.

TABLE 2

| MEASURING POINT | LUMINANCE (cd/m²) |
|---|---|
| 1 | 2,900 |
| 2 | 3,000 |
| 3 | 3,000 |
| 4 | 3,000 |
| 5 | 3,000 |
| 6 | 2,800 |
| 7 | 1,700 |
| 8 | 1,200 |
| 9 | 2,800 |
| 10 | 4,500 |
| 11 | 4,500 |
| 12 | 4,100 |
| 13 | 4,100 |
| 14 | 4,500 |
| 15 | 4,200 |

(3) Consideration of Spacing between Tube Surface of Fluorescent Lamp and Multi-prism Sheet and formation of Dark Portion Although the distance between a tube surface of the fluorescent lamp and the multi-prism sheet was 8 mm in the construction of the planar light-source device which conducted the measurement in the table 2, it was confirmed how the width of the stripe-like dark portion varied depending upon the distance between the tube surface of the fluorescent lamp and the multi-prism sheet.

Figure 4:
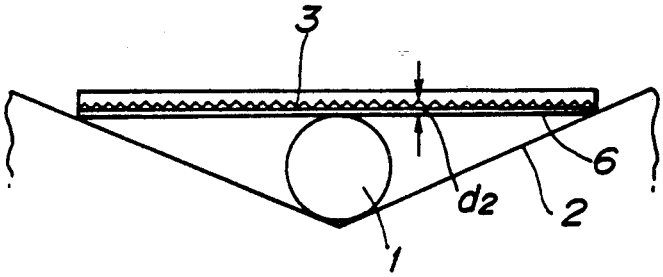
FIG. 4 is a fragmentary cross-sectional view of an example which is used to consider a width of a stripe-like dark portion.

The transparent acrylic resinous plate having the thickness of 3 mm at the upper location of the light box was first removed. A spacer 6 consisting of a transparent acrylic resinous plate for setting a spacing was interposed in the fluorescent lamp 1 as shown in FIG. 4, and the thickness of the spacer 6 changed to vary a spacing of $d_2$ thereby conducting measurement.

The results of the measurement were indicated in the table 3.

TABLE 3

| | | | | | | |
|---|---|---|---|---|---|---|
| DISTANCE OF $d_2$ (mm) | 1 | 2 | 4 | 8 | 16 | 23 |
| WIDTH OF PE-LIKE DARK PORTION (mm) | 3 | 7 | 13 | 20 | 35 | 45 |

As will be apparent from these results, it was known that, if the distance of $d_2$ decreased, the width of the dark portion was gradually reduced. Thus, with reference to this fact, it was confirmed that the apparatus having this construction was put into practical use.

From the viewpoint of practical use, however, it was desirable that such dark portion was eliminated. Accordingly, consideration was further given. Specifically, when the spacer 6 was removed from the construction illustrated in FIG. 4, and the multi-prism sheet was in direct contact with the tube surface of the fluorescent lamp (that is, $d_2=0$), the dark portion disappeared and, conversely, a band or stripe higher in luminance than the circumstance appeared which had its width of 3-5 mm.

From the above, it was known that there was a distance, at which the luminance difference disappeared, between $d_2=0-1$ mm. Thus, observation by the use of a polyester film having its thickness of 0.1 mm as the spacer 6 made it possible to obtain a uniform state having no luminance difference between $d_2=0.3$ mm and 0.4 mm. Accordingly, it was confirmed that the use of the spacer capable of maintaining the distance eliminated the dark portion. Since, however, this spacing was extremely small, application of the spacer to the planar light-source device and the illumination apparatus lacked in practicality. Thus, the invention tried that the dark portion disappeared by other means.

(4) Consideration of Dark-portion Removing Sheet

The stripe-like dark portion is caused due to the fact that outgoing of the light in the normal (L in FIG. 3) direction with respect to the prism at the location immediately above the fluorescent lamp is less (the light incident in the normal direction outgoes generally from 60° -80°) Accordingly, the dark portion can be eliminated by the fact that the light outgoing at a angle separated from the normal direction converges at the dark portion. As a sheet having such function, it has been considered that a translucent plate or a opal plate having a certain degree of diffuseness is suitable. Thus, the acrylic resinous opal plates of various grades (six (6) types) were first prepared to measure the optical performance. The opal plates used were as follows:

Acrylic resinous opal plate manufactured by MITSUBISHI RAYON CO,. LTD. "ACRYLITE #432" (Thickness: 2 mm)

Acrylic resinous opal plate manufactured by MITSUBISHI RAYON CO,. LTD. "ACRYLITE #422" (Thickness: 2 mm)

Acrylic resinous opal plate manufactured by MITSUBISHI RAYON CO,. LTD. "ACRYLITE #609" (Thickness: 2 mm)

Acrylic resinous opal plate manufactured by MITSUBISHI RAYON CO,. LTD. "ACRYLITE #610" (Thickness: 2 mm)

Acrylic resinous opal plate manufactured by MITSUBISHI RAYON CO,. LTD. "ACRYLITE #613" (Thickness: 2 mm)

Acrylic resinous opal plate manufactured by MITSUBISHI RAYON CO,. LTD. "ACRYLITE #M3" (Thickness: 1 mm)

In connection with the above, a distribution of the incident angles and the outgoing angles was arranged such that a goniometer manufactured by MURAKAMI SHIKISAI KENKYU SHO was used to alter light-beam incident angles of respective samples thereby measuring a transmitted-light distribution, and peak outgoing angles with respect respectively to the incident angles, and an angle width (half-value) at the time its strength was reduced to half values of respective peak outgoing strengths were obtained. The entire light-ray transmittance was measured in conformity with JIS-K7105.

The results of the measurement are depicted in the table 4.

TABLE 4

| | DISTRIBUTION OF INCIDENT ANGLE AND OUTDOING ANGLE (°) | | | | | ENTIRE LIGHT-RAY TRANSMITTANCE (%) |
|---|---|---|---|---|---|---|
| #432 | INCIDENT ANGLE | 0 | 20 | 40 | 60 | 61.5 |
| | PEAK OUTGOING ANGLE | 0 | 15 | 25 | 30 | |
| | ANGLE WIDTH | 86 | 80 | 76 | 70 | |
| #422 | INCIDENT ANGLE | 0 | 20 | 40 | 60 | 81.5 |
| | PEAK OUTGOING ANGLE | 0 | 17.5 | 32.5 | 40 | |
| | ANGLE WIDTH | 56 | 56 | 57 | 54 | |
| #609 | INCIDENT ANGLE | 0 | 20 | 40 | 60 | 76.2 |
| | PEAK OUTGOING ANGLE | 0 | 20 | 35 | 45 | |
| | ANGLE WIDTH | 40 | 40 | 50 | 50 | |
| #610 | INCIDENT ANGLE | 0 | 20 | 40 | 60 | 83.9 |
| | PEAK OUTGOING ANGLE | 0 | 20 | 40 | 60 | |
| | ANGLE WIDTH | 15 | 15 | 18 | 20 | |
| #613 | INCIDENT ANGLE | 0 | 20 | 40 | 60 | 66.1 |
| | PEAK OUTGOING ANGLE | 0 | 10 | 27.5 | 32.5 | |
| | ANGLE WIDTH | 83 | 76 | 76 | 57 | |
| #M3 | INCIDENT ANGLE | 0 | 20 | 40 | 60 | 60.9 |
| | PEAK OUTGOING ANGLE | 0 | 10 | 17.5 | 22.5 | |
| | ANGLE WIDTH | 100 | 95 | 88 | 85 | |

TABLE 4-continued

| DISTRIBUTION OF INCIDENT ANGLE AND OUTDOING ANGLE (°) | ENTIRE LIGHT-RAY TRANSMITTANCE (%) |
|---|---|
| WIDTH | |

(5) Evaluation of Performance at the Time Dark-portion Removing Sheet is Used.

The light box (provided with the multi-prism sheet through a transparent acrylic resinous plate having its thickness of 3 mm) at the time the luminance of the multi-prism sheet was measured was used, and the opal plate further rested on the light box, to measure the luminance (called a case A). Moreover, for comparison, the case where only the multi-prism sheet rested on the light box (a case B) and the case where only the opal plate rested on the light box (a case C) were also measured.

The results of the measurement were shown in FIGS. 6 through 11, and it was confirmed that advantages of the uniformity due to the dark-portion removing sheet were remarkable. In this connection, in the graphs in these figures, the case A is expressed by the marks +, the case B is expressed by the marks □, and the case C is expressed by the marks ◊.

(6) Confirmation of Functions of Reflecting Surface

Figure 5:
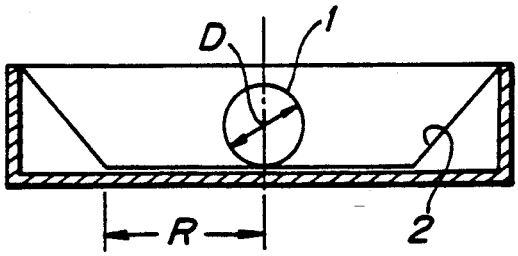
FIG. 5 is a cross-sectional view of a light box which is used to consider a configuration of a reflecting surface.
Figure 6:
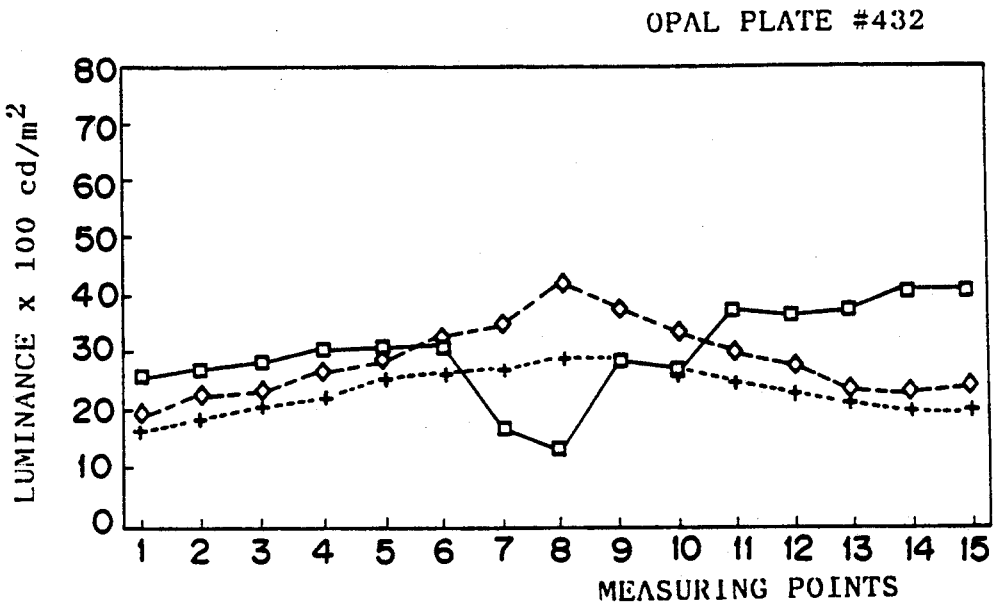
FIGS. 6 through 11 are graphs evaluating performance in the first embodiment of the invention.
Figure 7:
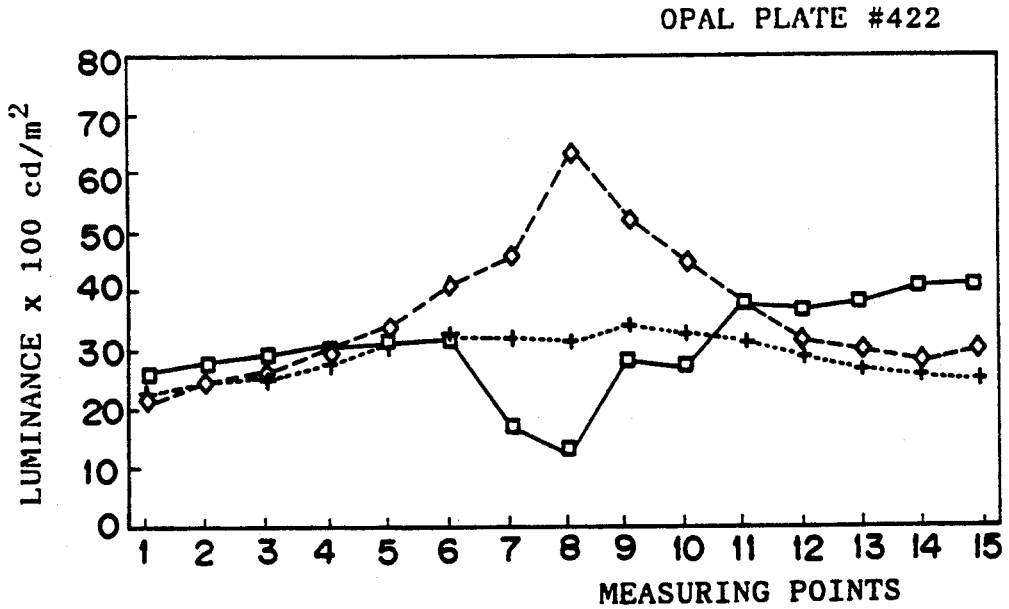
Figure 8:
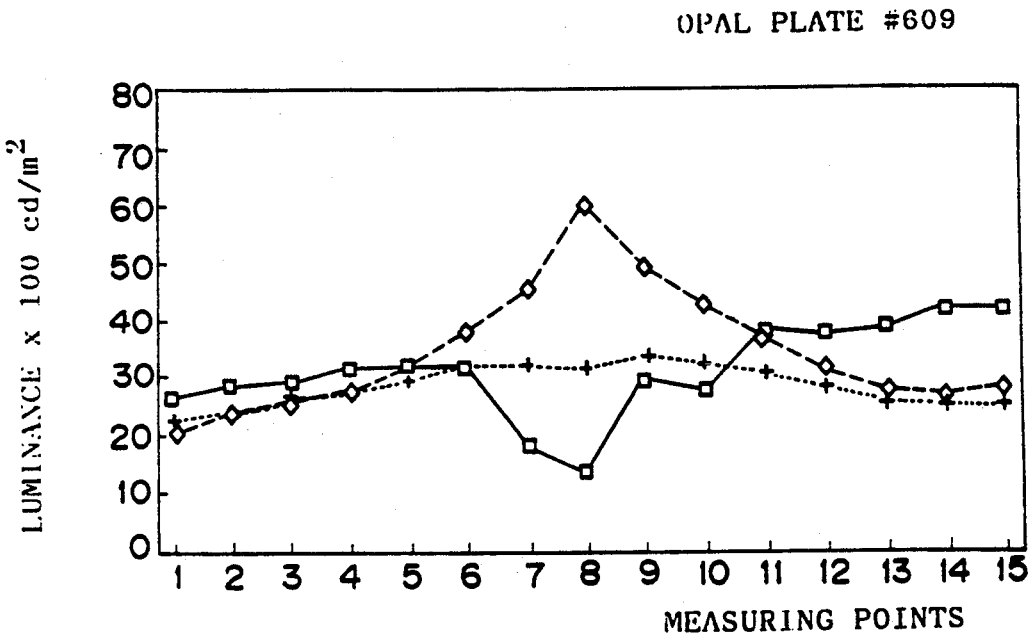
Figure 9:
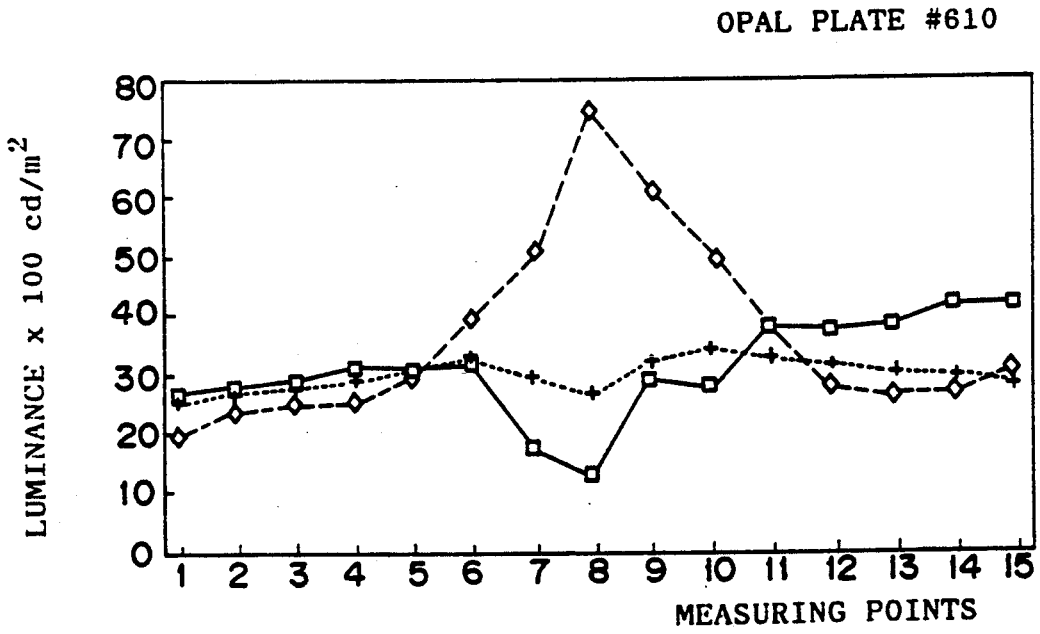
Figure 10:
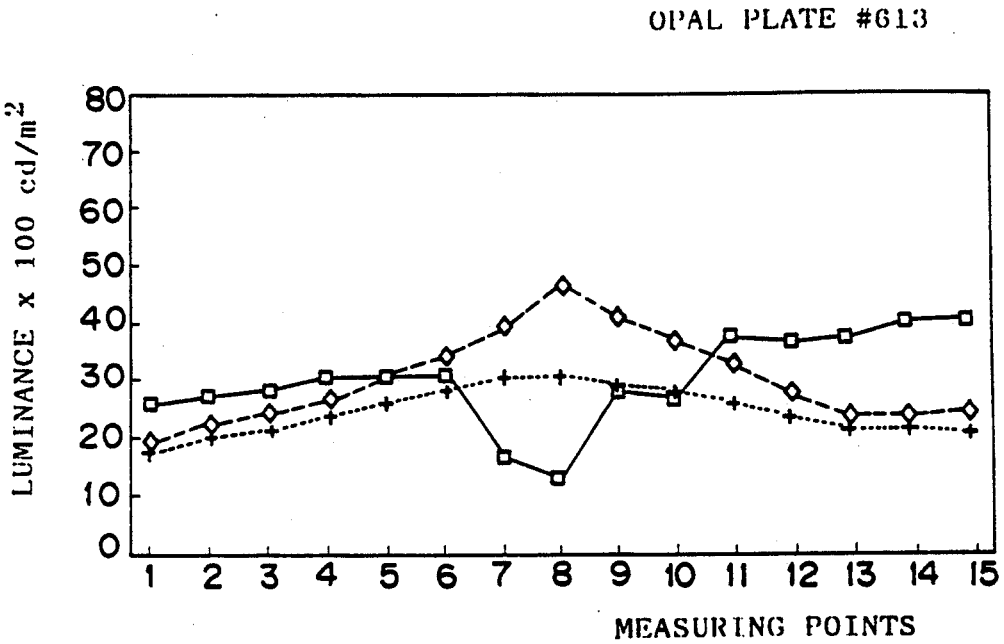
Figure 11:
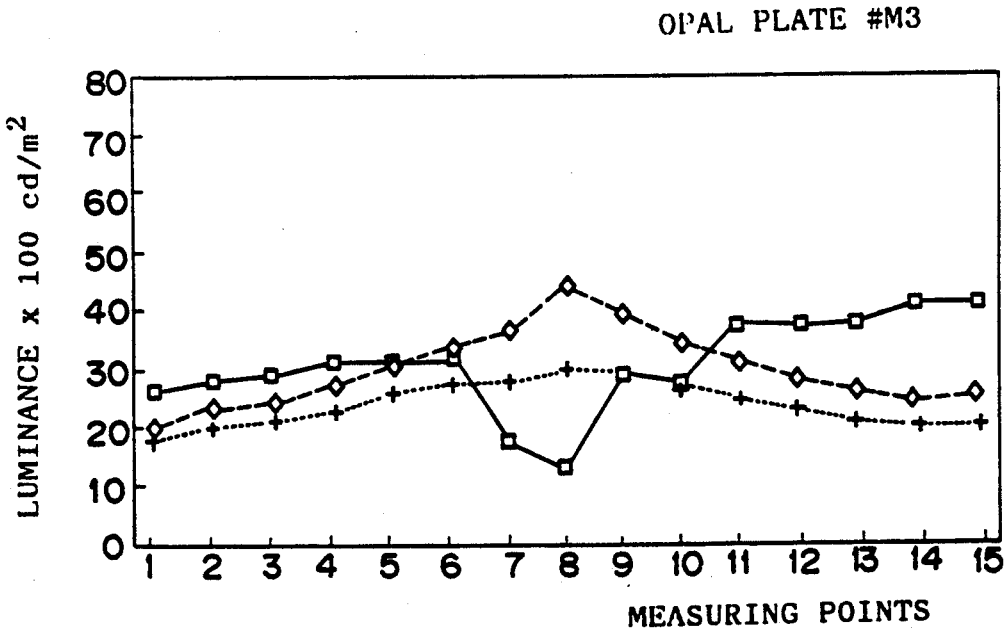

The above embodiment is arranged such that the reflecting surface 2 is provided in an inclined manner as shown in FIG. 2 or FIG. 4, and the light reflected by a major surface except for the location immediately below the linear light source is incident obliquely upon the multi-prism sheet 3 and, more particularly, the light is incident upon the normal of the prisms at an angle of the order of 50°-80°. This is one of conditions for achieving the function of the invention. In order to confirm this point, consideration was made by the use of the reflecting surface 2 having, at its bottom surface, a planar portion as shown in FIG. 5. The consideration caused us to know that, when the distance R of the planar surface was brought to R=2D through R=3D with respect to the diameter D of the fluorescent lamp, the portion of R became dark so that the uniformity could not be achieved.

Figure 12:
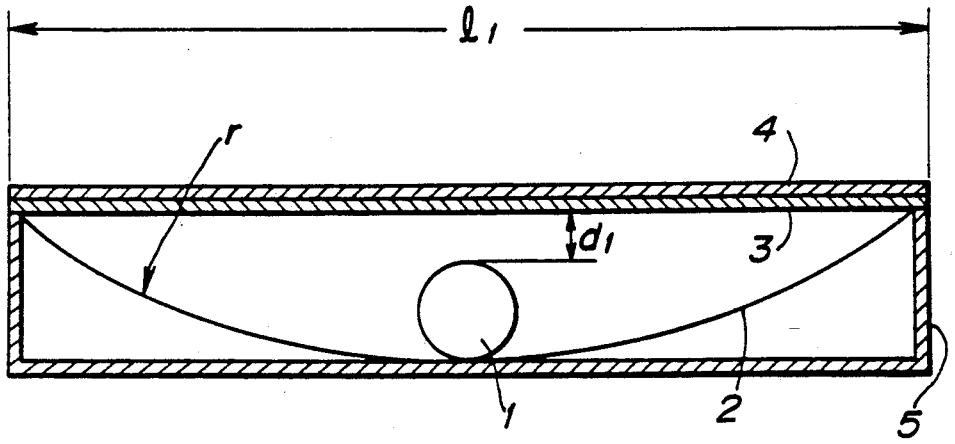
FIG. 12 is a cross-sectional view showing another embodiment of the invention.

Second Embodiment: Embodiment in which the reflecting surface consists of a curved surface FIG. 12 is a cross-sectional view of an embodiment of the invention. Here, the reference numeral 1 denotes a light source; 2, a reflecting surface; 3, a multi-prism sheet; 4, a dark-portion removing sheet; and 5, a housing.

The second embodiment is chiefly different from the first embodiment illustrated in FIGS. 1 and 2 in the configuration of the reflecting surface 2, but other portions are substantially the same as those of the first embodiment. In this connection, the cross-sectional configuration of the reflecting surface 2 in the direction of $l_1$ is an arc having a radius of curvature r.

In FIG. 12, the multi-prism sheet 3 has its lower surface which is formed with a group of prisms as shown in FIG. 3, similarly to those illustrated in FIG. 2. The group of prisms are omitted from illustration.

(1) Comparison in Luminance Uniformity Due to Configuration of Reflecting Surface The multi-prism sheet and the dark-portion removing sheet described with reference to the first embodiment rested on the light box described in (1) of the first embodiment in the mentioned order. Used as the "ACRYLITE #609", "ACRYLITE #432" and "ACRYLITE #M3". These three types of devices are called Ex 1-A, Ex 1-B and Ex 1C, respectively.

Likewise, with reference to the construction of the second embodiment, three types of light boxes were formed in the similar manner, and the prism sheet and the dark-portion removing sheet likewise rested in the mentioned order. Here, the radius of curvature r of the reflecting surface was 100 mm. Further, used as the dark-portion removing sheet were "ACRYLITE #609", "ACRYLITE #432" and "ACRYLITE #M3". These three types of devices are called Ex 2-A, Ex 2-B and Ex 2-C, respectively.

Luminance measurement was conducted with reference to each of the above devices in a manner similar to that described with reference to (1) of the first embodiment, to investigate a maximum difference among all the measuring points. By doing so, the uniformity in luminance can be known.

The results of the investigation are depicted in the table 5.

TABLE 5

| DEVICE | MAXIMUM DIFFERENCE IN LUMINANCE ($cd/m^2$) |
|---|---|
| Ex 1-A | 1,800 |
| Ex 1-B | 1,700 |
| Ex 1-C | 1,800 |
| Ex 2-A | 1,000 |
| Ex 2-B | 1,200 |
| Ex 2-C | 1,100 |

As will be apparent from the above results, the uniformity in luminance could be improved by the arrangement of the reflecting surface by the curved surface, as compared with the device in which the reflecting surface was formed by the planar surface.

(2) Relationship between Distance between Lamp and Multi-prism Sheet and Device Effective Width Next, it was investigated how the uniformity in luminance varied by variation of a distance between the lamp and the multi-prism sheet.

Here, used as the light source 1 were fluoresent lamps "FL-10W" (AC 100V, 10 W, 25 mmϕ) manufactured by TOSHIBA CO., LTD and "FL-30S·EX-N" (AC 100V, 30 W, 32 mmϕ) manufactured by NIPPON ELECTRIC CO., LTD. These lamps are called La-1 and La-2, respectively. The multi-prism sheet 3 and the dark-portion removing sheet 4 were used which were similar to those in the first embodiment. In this connection, the type of the light source (lamp) used, the magnitude of $d_1$ and the magnitude of $l_1$ were set whereby the radius of curvature r of the reflecting surface 2 was uniquely determined. Further, $l_2$ was brought to 300 mm.

$d_1$, $l_1$, r, the type of the light source used and $l_1/D$ in specific constitutional examples Con-1–Con-9 of the respective devices illustrated in FIG. 12 are depicted in the following table 6. Here, D is a diameter of the light-source lamp.

TABLE 6

| CONSTITUTIONAL EXAMPLE | $d_1$ (mm) | $l_1$ (mm) | r (mm) | LIGHT SOURCE | $l_1/D$ |
|---|---|---|---|---|---|
| Con-1 | 7 | 143 | 95.9 | La-1 | 5.72 |
| Con-2 | 9 | 150 | 100.1 | La-1 | 6.00 |
| Con-3 | 20 | 250 | 196.3 | La-1 | 10.00 |
| Con-4 | 20 | 300 | 272.7 | La-1 | 12.00 |
| Con-5 | 10 | 300 | 288.8 | La-2 | 9.38 |
| Con-6 | 20 | 300 | 242.3 | La-2 | 9.38 |
| Con-7 | 28 | 300 | 217.6 | La-2 | 9.38 |
| Con-8 | 35 | 300 | 217.9 | La-1 | 12.00 |
| Con-9 | 25 | 250 | 181.6 | La-1 | 10.00 |

Luminance measurement was done with reference to the respective constitutional examples in a manner like that described in (1) of the first embodiment. In this connection, the luminance measurement was done also with respect to the same constitutional example in which the dark-portion removing sheet was replaced by anther one.

The used dark-portion removing sheet, the mean luminance values and the luminance uniformity are depicted in the following table 7, with reference to the constitutional examples Con-1–Con-9. Here, the luminance uniformity was calculated by the following equation.

TABLE 7

| CONSTITUTIONAL EXAMPLE | DARK-PORTION REMOVING SHEET | MEAN LUMINANCE ($cd/m^2$) | LUMINANCE UNIFORMITY (%) |
|---|---|---|---|
| Con-1 | #609 | 3820 | +10.5 |
| Con-2 | #609 | 3630 | +12.4 |
| Con-3 | #609 | 2660 | +17.9 |
| | #432 | 2320 | +22.2 |
| | #M3 | 2260 | +20.3 |
| Con-4 | #609 | 2000 | +25.8 |
| | #432 | 1720 | +33.7 |
| | #M3 | 1690 | +32.2 |
| Con-5 | #609 | 4010 | +40.6 |
| | #432 | 3520 | +49.6 |
| | #M3 | 3400 | +48.5 |
| Con-6 | #609 | 3880 | +26.5 |
| | #432 | 3450 | +30.3 |
| | #M3 | 3380 | +28.7 |
| Con-7 | #609 | 3590 | +9.2 |
| | #432 | 3250 | +10.0 |
| | #M3 | 3180 | +10.7 |
| Con-8 | #609 | 2100 | +9.5 |
| Con-9 | #609 | 2750 | +9.1 |

Figure 13:
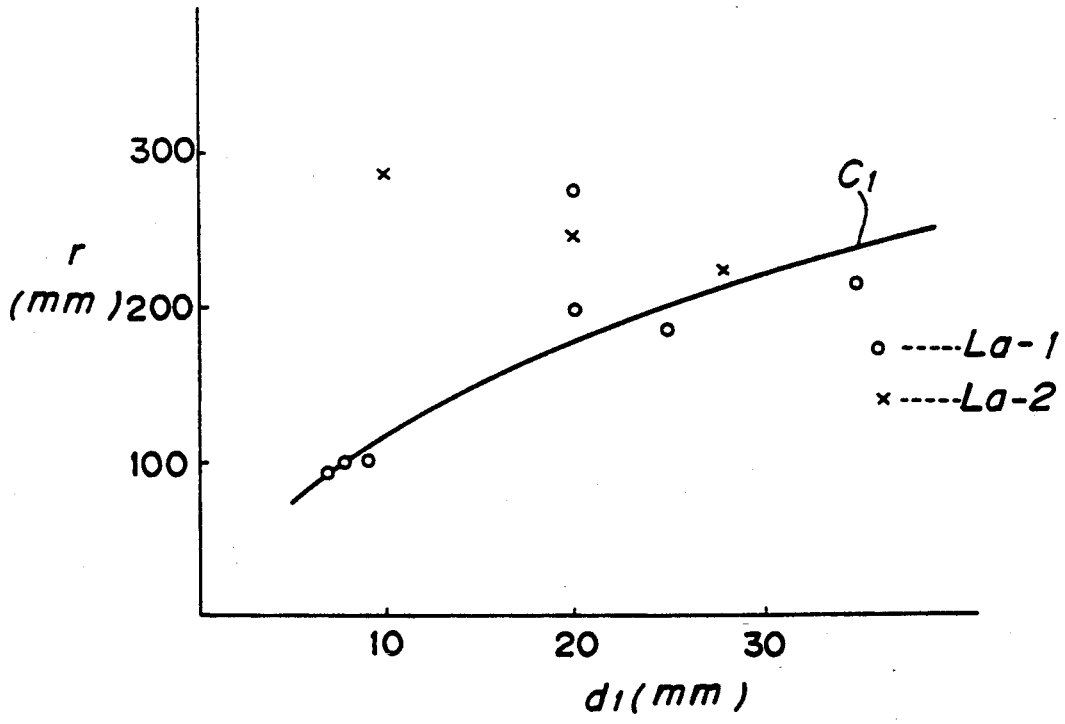
FIGS. 13 and 14 are graphs showing a characteristic of the embodiment illustrated in FIG. 12.

Of the constitutional examples Con-1 !A Con-9, the constitutional examples which use "Acrylite #09", AND plotting of the relationship between $d_1$ and r with respect to the device Ex 2-A in (1) are shown in the graph illustrated in FIG. 13. Considering that the allowable range was about +10% in luminance uniformity, the relationship between r and $d_1$ within the allowable range approximated to the following cubic expression (1) by the method of least squares.

$$r \leqq 22.12 + 11.33d_1 - 20.94d_1^2/10^2 + 1.747d_1^3/10^3 \quad (1)$$

This range corresponds to a portion below a curved line $C_1$ in FIG. 13.

If the diameter D of the lamp used and the distance $d_1$ are determined by utilization of the expression (1), an upper limit of r is set in order to bring the luminance uniformity to a value within the allowable range. Thus, the maximum value of the width $l_1$ is uniquely obtained.

After all, if the used lamp and the depth of the housing are set, the maximum width of the housing capable of maintaining the luminance uniformity is calculated so that the design of the planar light-source device can be made easy extremely.

With reference to both the cases where the lamp diameter D is 25 mmo and 32 mmϕ, the relationship between $d_1$ and $l_1$ approximated to the following cubic expressions (2) and (3), correspondingly to the above expression (1).

In the case where D=25 mmϕ, $$l_1 \leqq 78.75 + 10.58d_1 - 17.79d_1^2/10^2 + 2.029d_1^3/10^3 \quad (2)$$

In the case where D=32 mmϕ, $$l_1 \leqq 100.35 + 9.03d_1 - 9.16d_1^2/10^2 + 0.693d_1^3/10^3 \quad (3)$$

Figure 14:
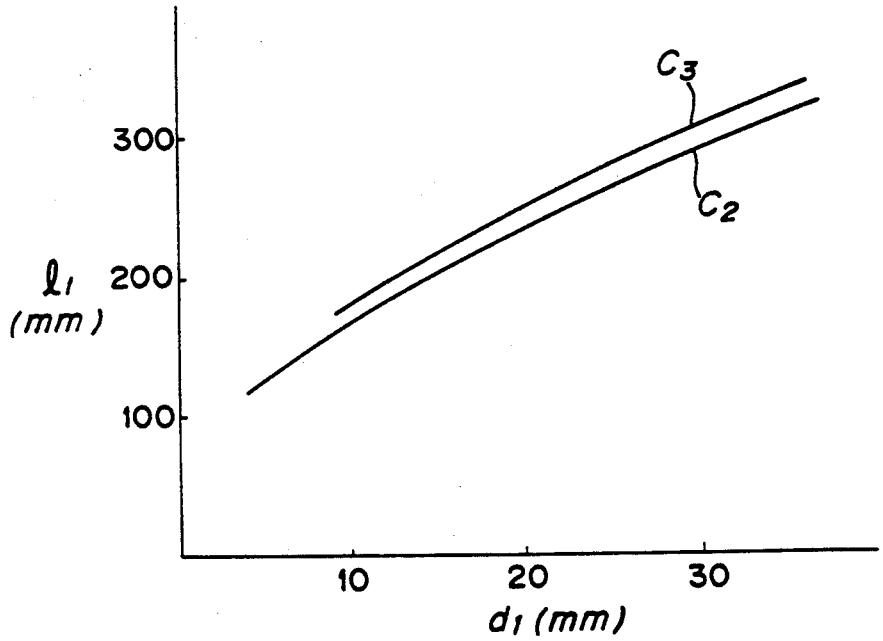

These ranges correspond to portions below the respective curved lines $C_2$ and $C_3$ in FIG. 14.

Third Embodiment: Embodiment using a plurality of light sources

Figure 15:
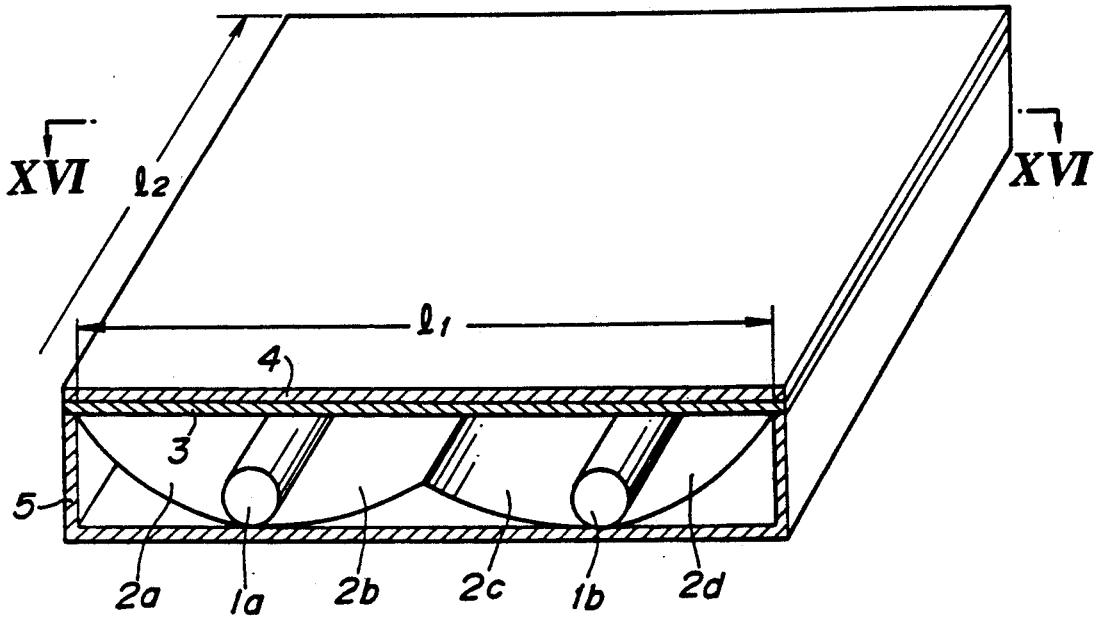
FIG. 15 is a fragmentary cross-sectional perspective view showing a second embodiment of the invention.
Figure 16:
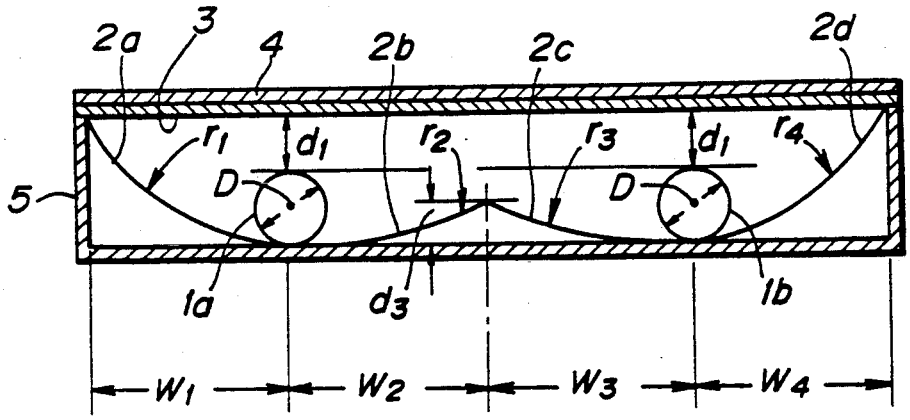
FIG. 16 is a cross-sectional view taken along the line XVI—XVI in FIG. 15.

FIG. 15 is a fragmentary cross-sectional perspective view of this embodiment. FIG. 16 is a cross-sectional view taken along the line XVI—XVI in FIG. 15. In the figures, the reference numerals 1*a* and 1*b* denote light sources; 2*a*, 2*b*, 2*c* and 2*d*, reflecting surfaces; 3, a multi-prism sheet; 4, a dark-portion removing sheet; and 5, a housing.

Of these elements, used as the light sources 1*a* and 1*b* were fluorescent lamps of 20 W whose tube diameter D was 32 mmo. Used as the reflecting surfaces 2*a*–2*d* were elements in which a polyester film having vacuum-deposited silver whose thickness is 25 microns was laminated onto a surface of an aluminum sheet whose thickness was 0.5 mm. Of course, the surface of the polyester film having vacuum-deposited silver is an upper surface.

These reflecting surfaces 2*a*–2*d* are contiguous to each other, forming a part of a cylinder. The radii of curvature $r_1$ and $r_4$ of the respective reflecting surfaces 2*a* and 2*d* were 127 mm, the widths $w_1$–$w_4$ of the respective reflecting surfaces 2*a*–2*d* were 100 mm, $l_1$ was 400 mm, $l_2$ was 350 mm, and $d_1$ was 17 mm.

$d_3$ was set to six kinds including 0 mm, 10 mm, 16 mm, 21 mm, 31 mm and 49 mm. The radii of curvature $r_2$ and $r_3$ of the respective reflecting surfaces $2_b$ and $2_c$ were set such that these reflecting surfaces were brought to horizontal at a location immediately below the light-source lamps, and each of $d_3$ was realized.

The multi-prism sheet 3 used in this example has also the configuration as illustrated in FIG. 3, similarly to the first embodiment, and has its thickness of 1 mm, a pitch P of 0.38 mm, prism angles $a_1$ and $a_2$ of 31.5°, and a head vertex angle of 63°.

Further, as the dark-portion removing sheet 4, "ACRYLITE #M3" was selected from those indicated in the table 4.

(1) Consideration in Height of Top of Ridgeline

In the device constitution like that described above, variation in the luminance distribution was investigated due to variation in height $d_3$ of the top of the ridgeline between the reflecting surfaces $2_b$ and $2_c$ between the light sources 1*a* and $1_b$.

Measurement was done such that the luminance of the surface was measured at nineteen (19) points equally divided at intervals of 20 mm in the direction of $1_1$ at the center in the direction of $1_2$. In this connection, measurement of the luminance used the luminance meter of nt-1 manufactured by MINOLTA CO., LTD, and was done such that a view field angle was lo and a spot diameter was 7 mmϕ.

Mean luminance and the maximum difference in luminance obtained by this measurement are depicted in the table 8.

TABLE 8

| $d_3$ (mm) | MEAN LUMINANCE (cd/m²) | MAXIMUM DIFFERENCE IN LUMINANCE (cd/m²) |
|---|---|---|
| 0 | 1830 | 390 |
| 10 | 1850 | 300 |
| 16 | 1850 | 270 |
| 21 | 1860 | 330 |
| 32 | 1850 | 430 |
| 49 | 1870 | 1000 |

In connection with the above, in the case where $d_3$=0 mm, a region between the lamps 1*a* and 1*b* became dark.

Moreover, in the case where $d_3$=32 mm and 49 mm, a bright line appeared at the center between the lamps 1*a* and 1*b*.

On the contrary, in the case where $d_3$=10 mm, 16 mm and 21 mm, the luminance uniformity was superior, and no special partial defects in luminance occurred.

Accordingly, it is understood that, from the viewpoint of realization of the superior luminance characteristic, it is preferable that $d_3$ is smaller than the tube diameter D and larger than 0 (that is, $0-d_3 \leqq D$). Particularly, it is desirable that $(\frac{1}{4})D \leqq d_3 \leqq (\frac{3}{4})D$.

(2) Description of Optimum Specific Example

From the results of the above consideration, it was confirmed that the top of the ridgeline was located above the bottom of the light source and below the top of the light source. Accordingly, consideration was made to the specific example, determining that $d_3$ was 16 mm and 19 mm.

The light source used in this time was a fluorescent lamp "FL-20SS·EX-N" (diameter: 28 mm) manufactured by MATSUSHITA DENKO CO., LTD. 11 was 400 mm, $r_1$ and $r_4$ were 127 mm, and $r_2$ and $r_3$ were 280 mm. The multi-prism sheet was used which was the same as that in the above specific example. Used as the dark-portion removing sheet was "ACRYLITE #432" (refer to FIG. 4) having its thickness of 2 mm. In this connection, the material of the reflecting surface was used which was the same as the above embodiment.

Figure 17:
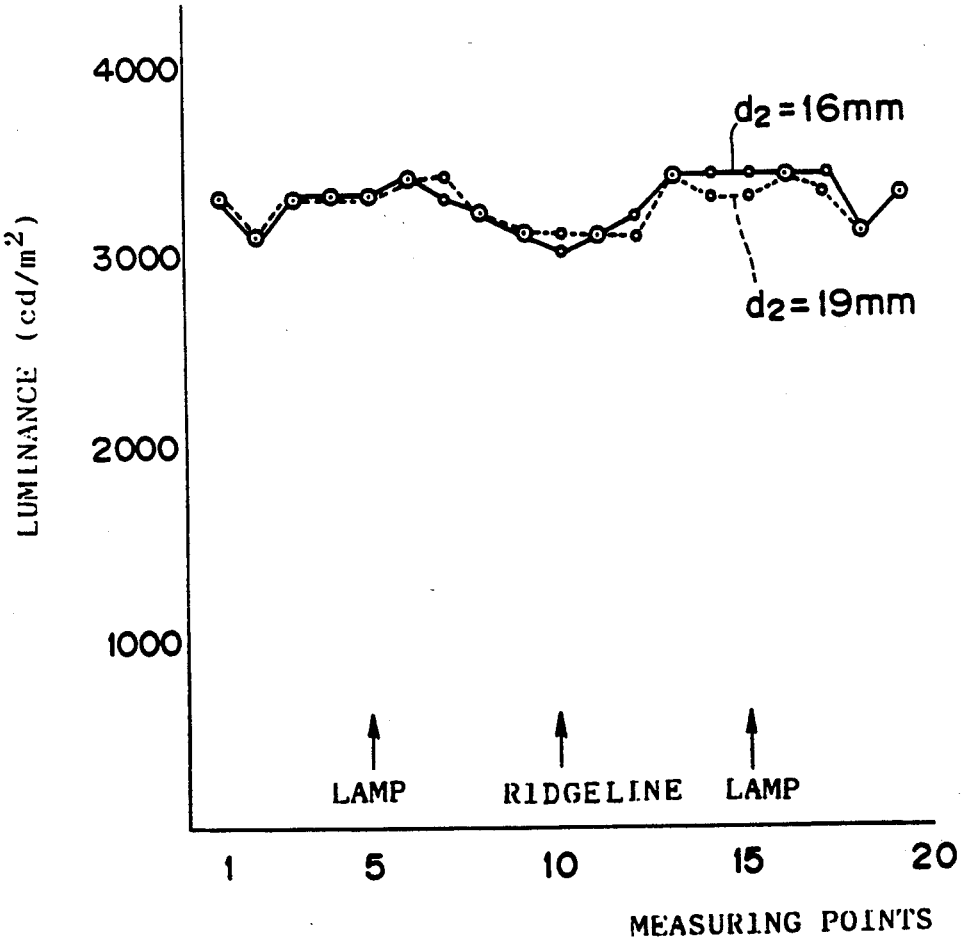
FIG. 17 is a graph evaluating performance in the second embodiment of the invention.

The results of the consideration are depicted in FIG. 17, in which the mean luminance exceeded 3000 cd/m² over the entire surface of the outgoing surface, and the uniformity was also extremely high and superior. The measuring points are nineteenth (19) points in the direction $1_1$, and the measurement of the luminance is the same as that described above.

Figure 18:
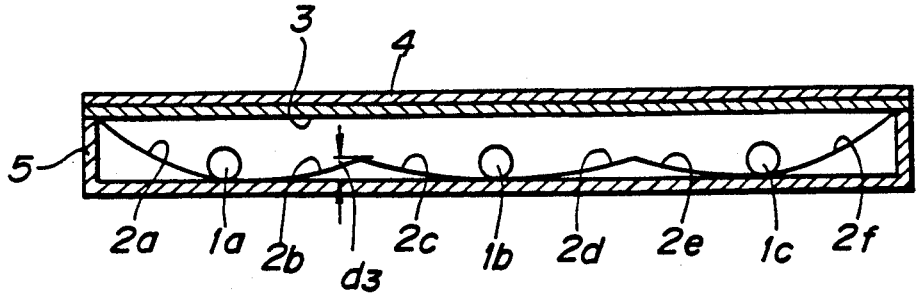
FIGS. 18 and 19 are cross-sectional views of other aspects of the second embodiment of the invention.
Figure 19:
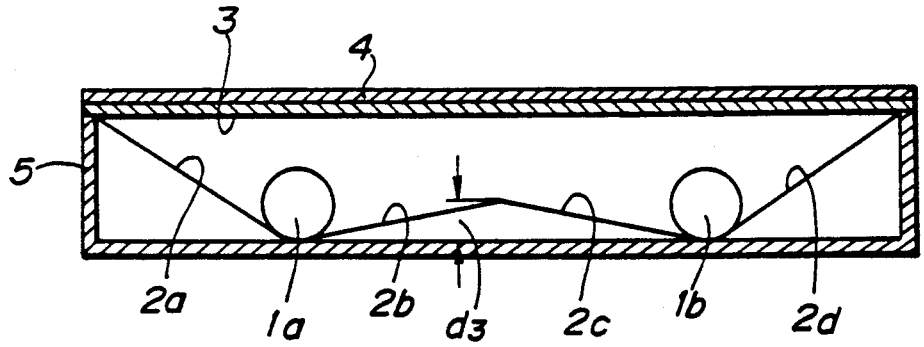

In the third embodiment, there are various aspects other than that described above, and these various aspects are shown in FIGS. 18 and 19.

FIG. 18 is a cross-sectional view of this example, showing a portion corresponding to the above FIG. 16.

In the figure, 1*a*, 1*b* and 1*c* denote light sources; 2*a*, 2*b*, 2*c*, 2*d*, 2*e* and 2*f*, reflecting surfaces; 3, a multi-prism sheet; 4, a dark-portion removing sheet; and 5, a housing.

In this embodiment, there are provided three light sources and, correspondingly thereto, reflecting surfaces are formed. Tops of respective ridgelines between the reflecting surfaces between the light sources 1a and 1b and between the light sources 1b and 1c have their height $d_3$ which is under the condition of $0 \leqq d_3 \leqq D$ with respect to the tube diameter D. In this manner, in the case where the number of light sources increases, the tops of the respective ridgelines between the respective reflecting surfaces between the light sources should be set such that the tops satisfy this condition.

FIG. 19 is a cross-sectional view of an embodiment of the invention, showing a portion corresponding to the above FIG. 16.

In the figure, 1a and 1b denote light sources; 2a, 2b, 2c and 2d, reflecting surfaces; 3, a multi-prism sheet; 4, a dark-portion removing sheet; and 5, a housing.

In the embodiment, each of the reflecting surfaces 2a–2d consists of a planar surface. Also in this case, a top of a ridgeline between the reflecting surfaces between the light sources 1a and 1b has its height $d_3$ which is under the condition of $0 \leqq d_3 \leqq D$, with respect to the tube diameter D.

Fourth Embodiment: Embodiment in which both sides are illuminated

Figure 20:
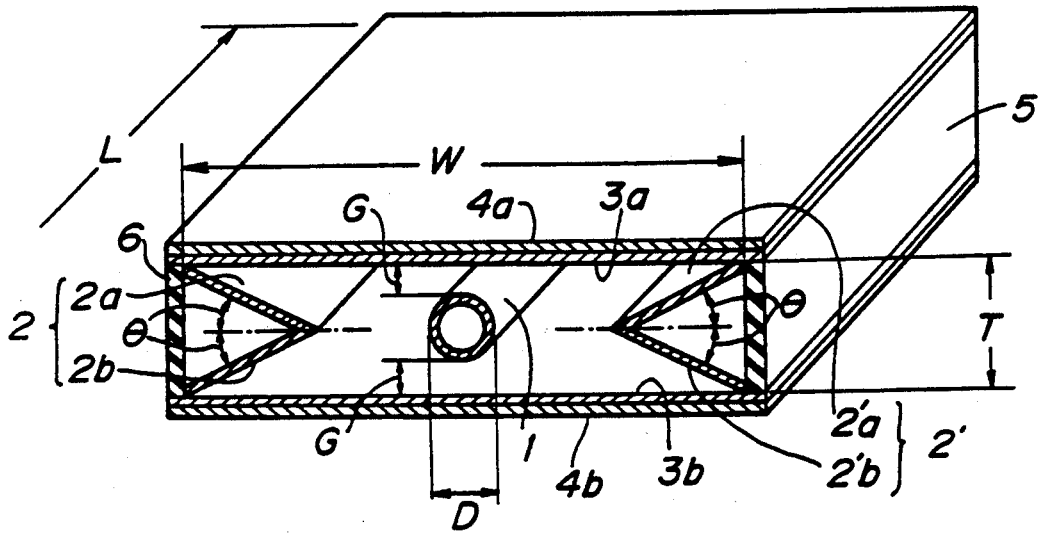
FIG. 20 is a fragmentary cross-sectional perspective view showing a third embodiment of the invention.

FIG. 20 is a fragmentary cross-sectional perspective view of this embodiment In this embodiment, used as a light source 1 was a fluorescent lamp "FL-10W" of 10 W whose tube diameter D was 25 mmϕ. Used as reflecting surfaces 2 and 2' were elements in which a polyester film having vacuum-deposited silver whose thickness was 25 μm was laminated onto a surface of an aluminum sheet whose thickness was 0.5 mm. Used as multi-prism sheets 3a and 3b were elements which were obtained such that a colorless and transparent acrylic resinous plate (thickness: 1 mm) was heat-pressed together with a mold, and in which a pitch P was 0.38 mm, prism angles $a_1$ and $a_2$ were 31.5° and a head vertex angle a was 63°. Used as dark-portion removing sheets 4a and 4b were "ACRYLITE #609" and "ACRYLITE #M3". Further, L was 350 mm, and W was 150 mm.

θ, T and G were suitably set to conduct luminance measurement. Since the rear-face side was similar to the front-face side, the measurement was conducted such that the luminance of the surface was measured at twelve (12) points at intervals of 10 mm, only on the front-face side, with the outermost side was a location of 20 mm from both ends int he W direction at the center in the L direction. In this connection, the measurement was made by the use of the luminance meter of nt-1 manufactured by MINOLTA CO., LTD, in which the view filed angle was 1°, and the spot diameter was 7 mmϕ.

the mean luminance (ML) obtained by this measurement and an R value of the luminance maximum value with respect to the mean luminance are depicted in the table 9.

TABLE 9

| CONSTITUTIONAL EXAMPLE No. | θ° | T (mm) | G (mm) | ML (cd/m²) | R VALUE (%) |
|---|---|---|---|---|---|
| 1 | 23 | 45 | 10 | 2450 | 15 |
| 2 | 27 | 45 | 10 | 2370 | 14 |
| 3 | 22.3 | 50 | 12.5 | 2490 | 18 |
| 4 | 27 | 53 | 14 | 2075 | 10 |
| 5-1 | 25.5 | 50 | 12.5 | 2370 | 11 |

TABLE 9-continued

| CONSTITUTIONAL EXAMPLE No. | θ° | T (mm) | G (mm) | ML (cd/m²) | R VALUE (%) |
|---|---|---|---|---|---|
| 6-1 | 30 | 50 | 12.5 | 2280 | 11 |
| 6-2 | 30 | 50 | 12.5 | 1970 | 11 |

In connection with the above, in the constitutional example No. 6-2, "ACRYLITE #M3" was used as the dark-portion removing sheets 4a and 4b. In the constitutional examples other than the above constitutional example, "ACRYLITE #609" was used as the dark-portion removing sheets 4a and 4b.

Next, for comparison, the luminance measurement similar to that described above was conducted with reference to an example (constitutional element No. 5-2) in which the dark-portion removing sheets 4a and 4b were removed from the constitutional example No. 5-1, an example (constitutional example No. 5-3) in which the multi-prism sheets 3a and 3b were removed from the above constitutional example No. 5-1, and an example (constitutional element No. 5-4) in which the multi-prism sheets 3a and 3b were removed from the above constitutional example No. 5-1 and "ACRYLITE #M3" was used as the dark-portion removing sheets 4a and 4b. The results of the measurement are depicted in the table 10.

TABLE 10

| CONSTITUTIONAL EXAMPLE No. | θ° | T (mm) | G (mm) | ML (cd/m²) | R VALUE (%) |
|---|---|---|---|---|---|
| 5-2 | 25.5 | 50 | 12.5 | 2940 | 51 |
| 5-3 | 25.5 | 50 | 12.5 | 2660 | 62 |
| 5-4 | 25.5 | 50 | 12.5 | 2440 | 34 |

Next, likewise, for comparison, the luminance measurement similar to that described above was conducted with reference to an example (constitutional element No. 6-3) in which the dark-portion removing sheets 4a and 4b were removed from the constitutional example No. 6-1, an example (constitutional example No. 6-4) in which the multi-prism sheets 3a and 3b were removed from the above constitutional example No. 6-1, and an example (constitutional element No. 6-5) in which the multi-prism sheets 3a and 3b were removed from the above constitutional example No. 6-2. The results of the measurement are depicted in the table 11.

TABLE 11

| CONSTITUTIONAL EXAMPLE No. | θ° | T (mm) | G (mm) | ML (cd/m²) | R VALUE (%) |
|---|---|---|---|---|---|
| 6-3 | 30 | 50 | 12.5 | 2950 | 53 |
| 6-4 | 30 | 50 | 12.5 | 2620 | 57 |
| 6-5 | 30 | 50 | 12.5 | 2330 | 29 |

Figure 21:
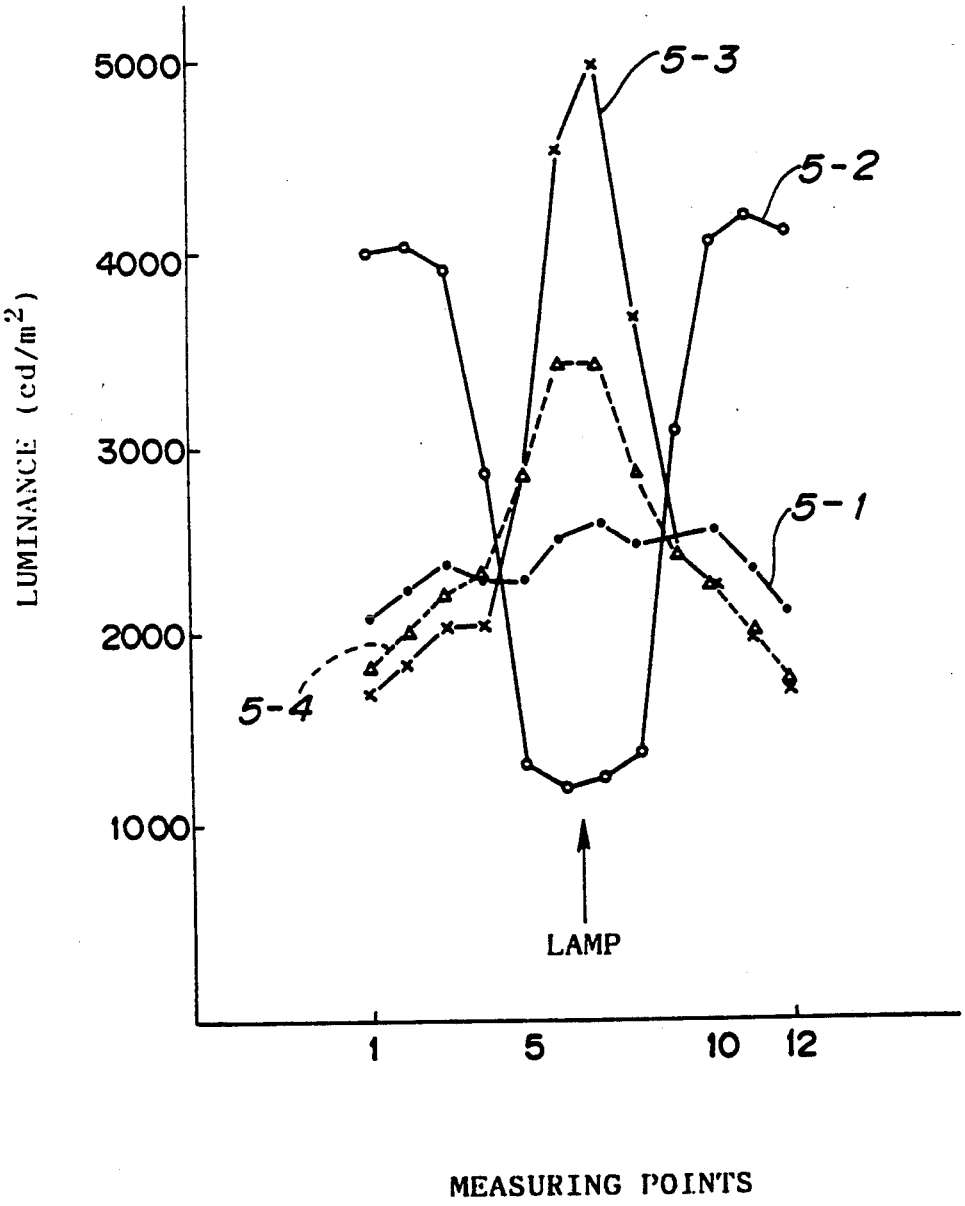
FIGS. 21 and 22 are graphs evaluating performance in the third embodiment.
Figure 22:
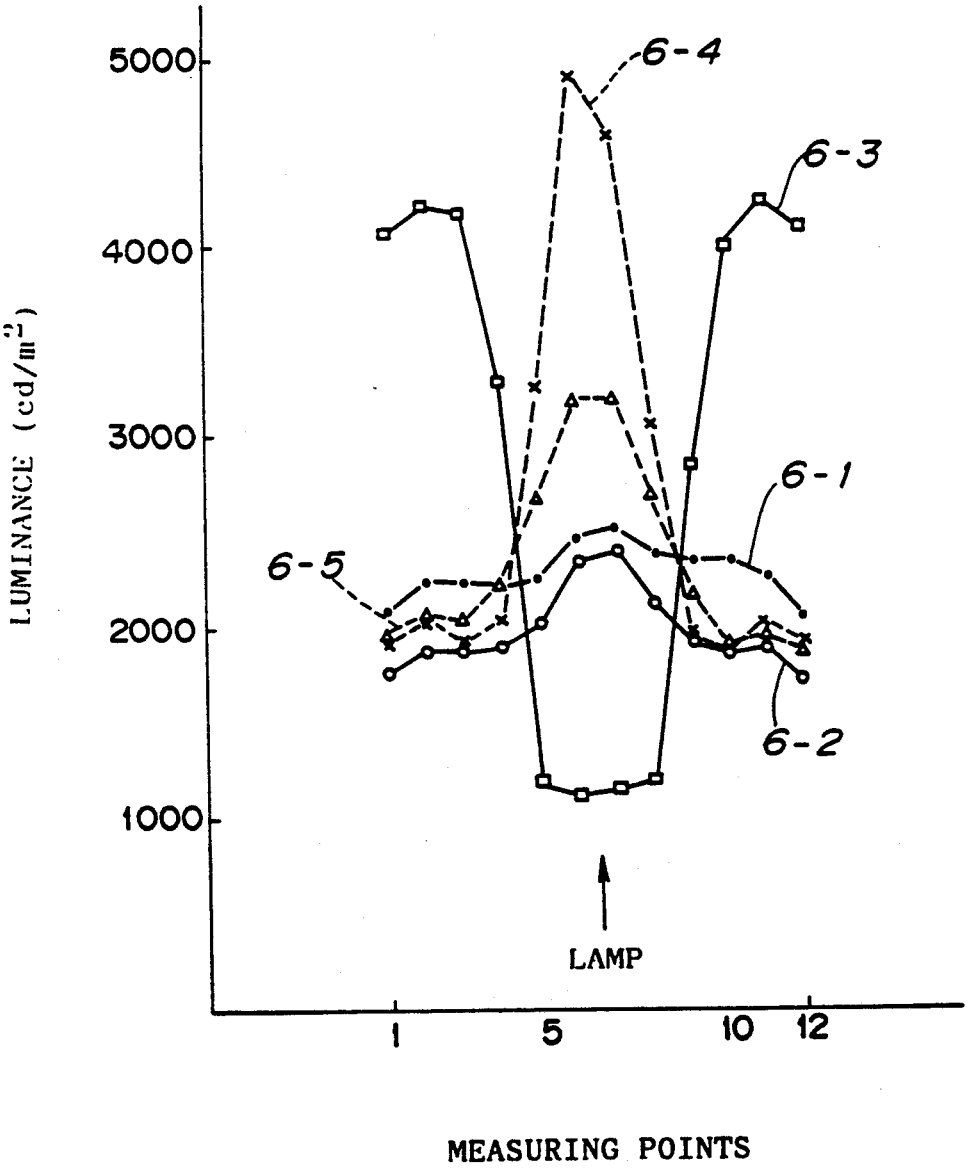

The results of the luminance measurement with respect to the constitutional examples No. 5-1–No. 5-4 are illustrated in FIG. 21, and the results of the luminance measurement with respect to the constitutional examples No. 6-1–No. 6-5 are illustrated in FIG. 22.

From the results described above, it is understood that presence of the reflecting surfaces 2 and 2 ; multi-prism sheets 3a and 3b and the dark-portion removing sheets 4a and 4b is important.

Various aspects other than the examples described above are possible in the embodiment of the invention.

Figure 23:
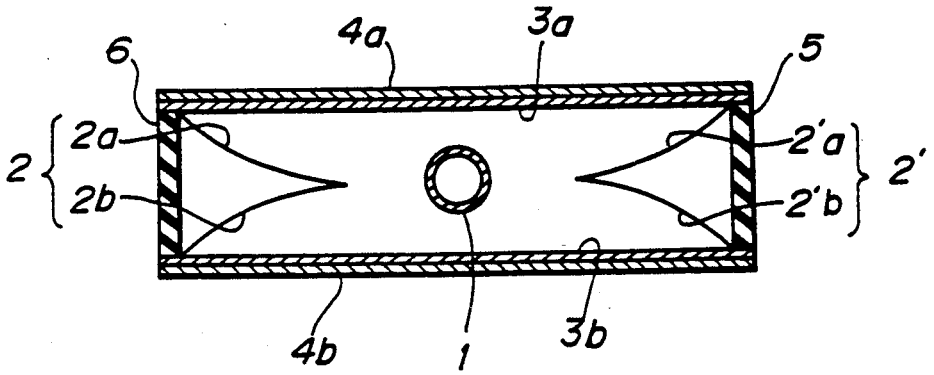
FIG. 23 is a cross-sectional view showing another aspect of the third embodiment of the invention.

FIG. 23 is a cross-sectional view showing an example. In the figure, components similar to these illustrated in FIG. 20 are designated by the same reference numerals.

This example differs from the example illustrated in FIG. 20 in the configuration of a pair of reflecting surfaces 2 and 2', and the front-face-side portion and the rear-face-side portion are formed into their respective configurations in which they have curved surfaces concave toward a multi-prism sheet 3*a* or 3*b*.

The description has been made above in detail in accordance with the embodiments. However, the contents of the invention should not be limited to these examples, but various modifications can be made to the invention. For instance, the light source of the invention may use, other than the linear light source such as the fluorescent lamp, light sources which are arranged linearly such as an LED array, a link lamp, a quenching lamp or the like.

The reflecting surface 2 can also select a suitable metallic reflecting surface or the like. If the reflecting surface has such function that a light from the light source is reflected to make a major light obliquely incident upon the multi-prism sheet 3, the reflecting surface does not care about its configuration such as, for example, a surface which is composed of any combination of planar surfaces having an upwardly concave surface, or the like.

As the multi-prism sheet 3 employed in the invention, it is possible to use, other than the acrylic resin, synthetic resin such as polycarbonate resin, styrene resin, vinyl chloride resin or the like, or inorganic glass. As the multi-prism sheet 3, it is possible to use not only an element like a plate (thickness: of the order of 0.5–5 mm), but also a film-like element thinner than the plate-like element. Further, the configuration of the prism should also be such that the direct light from the linear light source or a light once reflected and incident from an oblique direction is concentrated in a direction perpendicular to the multi-prism sheet 3 or in an optional direction to set the prism angle in accordance with the direction in which the light outgoes. In this connection, the surface in which the group of prisms are not formed may be a fine roughened surface such as a mat-finishing surface or the like.

In connection with the above, in the case where a thin plate or a film is used as the multi-prism sheet 3 or the dark-portion removing sheet 4 and in case of necessity, a transparent plate for prevention of deflection may be interposed between the multi-prism sheet 3 and the light source 1.

Figure 24:
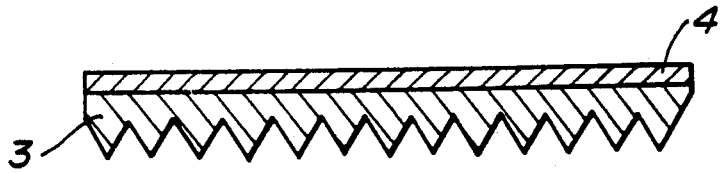
FIG. 24 is a cross-sectional view showing an example of an optical sheet which is used in the invention.
Figure 25:
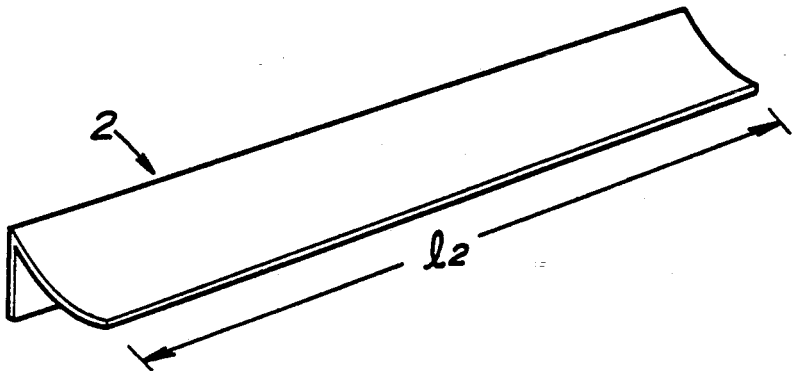
FIG. 25 is a perspective view showing an example of a reflecting element which is used in the invention.

Moreover, as the multi-prism sheet 3 and the dark-portion removing sheet 4 of the invention, it is also possible to use an element in which the multi-prism sheet and the dark-portion removing sheet are bonded together and united as shown, for example, in FIG. 24 at manufacture of the multi-prism sheet 3 or at timing differentiated from the manufacture. Further, such as FIG. 25, the reflecting surface 2 may also be constructed such that a plurality of units having their halves resting, extending along the light source and having its length which is substantially equal to the light source may be used, with two units used in the example illustrated in FIG. 1, and with four units used in the example illustrated in FIG. 23.

Examples, in which the planar light-source device according to the invention is applied to various illumination apparatuses, will next be described with reference to the drawings.

Figure 26:
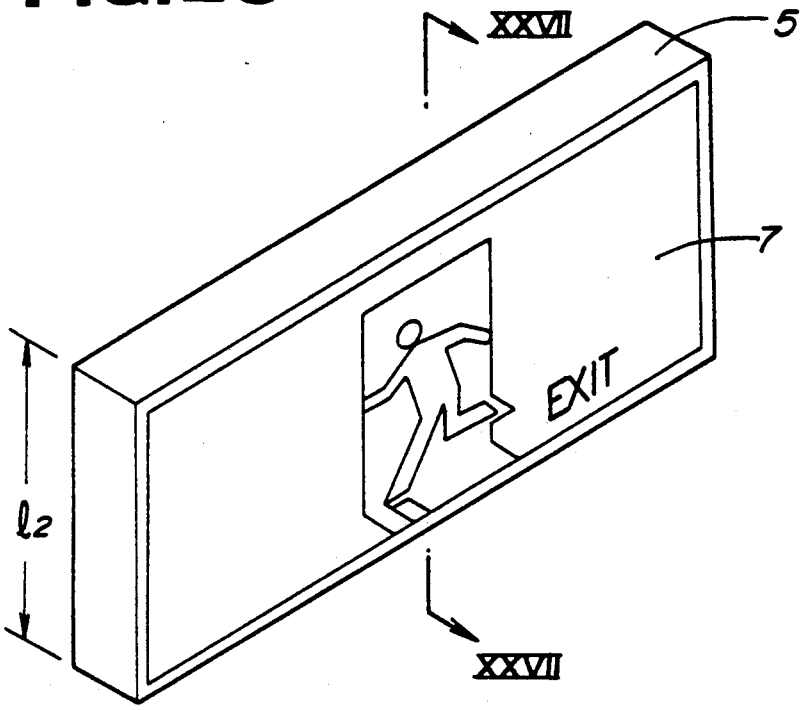
FIG. 26 is a perspective view showing an example of an illumination apparatus in which the invention is used as a display device of internal illumination type.

FIG. 26 is an example of a guidance lamp which is so used as to be mounted to an emergency exit or the like. The guidance lamp has its front face which is provided with a display 7 indicating guidance In this connection, the cross-section except for the display (generally, a printed plastic sheet) is substantially the same as that illustrated in FIG. 2 The guidance lamp is uniform and bright, and it is possible to thin the housing 5. As described previously, this example is substantially the same as the cross-section illustrated in FIG. 2 and, accordingly, description will be made quoting this. The housing designated by the reference numeral 5 serves also as a housing for the illumination apparatus. The multi-prism sheet 3 and the dark-portion removing sheet 4 are arranged on the side of the front face of the housing 5, and the reflecting surface 2 is provided on the side opposite to the light source 1. The display 7 illustrated in FIG. 26 is provided further on the side of the front face of the multi-prism sheet 3.

In connection with the above, when the length of the illumination apparatus in the 12 direction increases to enlarge the area, it is preferable that the planar light-source source device illustrated in FIG. 15 or FIG. 18 is incorporated in the illumination apparatus. Further, when displays are provided respectively on the both sides, it is preferable that the planar light-source device illustrated in FIG. 20 or FIG. 23 is incorporated in the illumination apparatus. The illumination apparatus shown in this figure is not limited to such guidance lamp, but is widely applicable to a display device for illuminating form its internal part. It is needless to say that other displays are mounted whereby a display illumination apparatus for various uses can be used, in which, if an advertisement display is mounted to the illumination apparatus, an advertisement lamp can be formed, in which, if a time display for trains is mounted to the illumination apparatus, a time display lamp can be formed and, furthermore, in which, if a part of an elongated destination display sheet is in contact with a display surface, a destination display board for buses, trains or the like can be formed, or the like.

Figure 27:
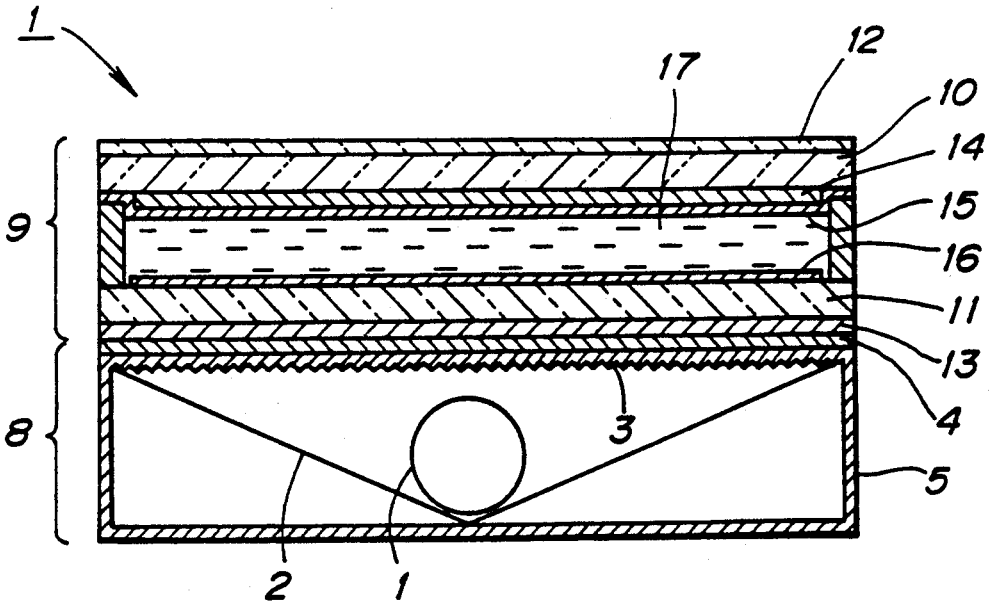
FIG. 27 is a cross-sectional view showing an example of the illumination apparatus in which the invention is used as a liquid-crystal display device.

FIG. 27 shows an illumination apparatus for a liquid-crystal display applied to the planar light-source device according to the invention. In the figure, the reference numeral 8 denotes a planar light-source device which is identical in constitution with the above-described planar light-source device. A liquid-crystal display element 9 rests on an illumination surface of the planar light-source device.

This liquid-crystal display device is arranged such that the light source 1 of the planar light-source device 8 is turned on to outgo a light toward the liquid-crystal element 9 from the front face of the multi-prism sheet 3 thereby applying an image signal voltage to a location between a pair of internal electrodes 15 and 16 of the liquid-crystal element 9, whereby a color image is depicted on a liquid-crystal display surface of the liquid-crystal display element 9. In this connection, the liquid-crystal display element 9 illuminated comprises a pair of glass substrates 10 and 11 spaced a predetermined distance by a spacer, a pair of deviation plates 12 and 13 provided respectively on the outer surfaces of the glass substrates 10 and 11, a color filter layer 14 provided on an inner surface of the upper glass substrate 10, the internal electrode 15 provided on an outer surface of the color filter layer 14, the internal electrode 16 provided on an inner surface of the lower glass substrate 11, and a liquid crystal 17 filled between the pair of glass substrates 10 and 11.

The internal electrode 16 is constructed such that a plurality of fine picture-elements electrodes are arranged longitudinally and laterally. Further, the color filter layer 14 is such that three color filters including red, green and blue are arranged correspondingly to the above-described picture-element electrodes to form picture elements.

The liquid-crystal display device 1 constructed as above has such an advantage that, in the planar light-source device 8, a major portion of a light reflected by the reflecting surface 2 is obliquely incident upon the multi-prism sheet 3, and the light directly or obliquely incident upon the multi-prism sheet 3 outgoes in concentration on the direction toward the liquid-crystal display device and, accordingly, the light from the light source 1 is effectively utilized so that there can be provided a liquid-crystal display device which is bright, high in uniformity and capable of being thinned sufficiently. It is needless to say that a digital-watch display element, a processor display element or a liquid-crystal display element for displaying guidance or advertisement is mounted in place of the color liquid-crystal display element, whereby such liquid-crystal display device can be used as liquid-crystal display devices for various uses.

Figure 28:
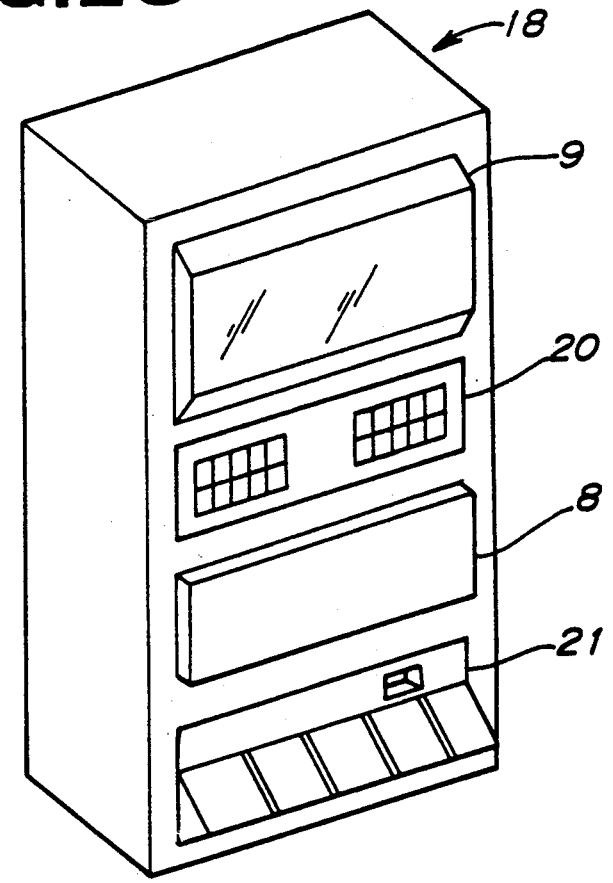
FIG. 28 is a perspective view showing an example in which the invention is used as an illumination apparatus for an automatic vending machine.

FIG. 28 shows an example in which the planar light-source device according to the invention is incorporated as an internal-illumination type display device for an automatic vending machine. Such automatic vending machine is extremely advantageous because an illumination apparatus large in depth cannot be mounted in relation to an accommodating space.

In this figure, the planar light-source device 8 according to the invention is arranged at the front face of the automatic vending machine 18. It is of course, however, that the invention is not limited to this example. Since, as the internal construction of the planar light-source device 8, the internal construction illustrated in FIG. 2 can be used as it is, the description of the internal construction will be omitted. A film or the like having applied thereto an optional display, or the like is bonded to the front face of the planar light-source device 8. In this connection, the reference numeral 19 in the figure denotes a sample exhibiting section; 20, a charge throwing and operational section; and 21, a commodity taking-out section.

Figure 29:
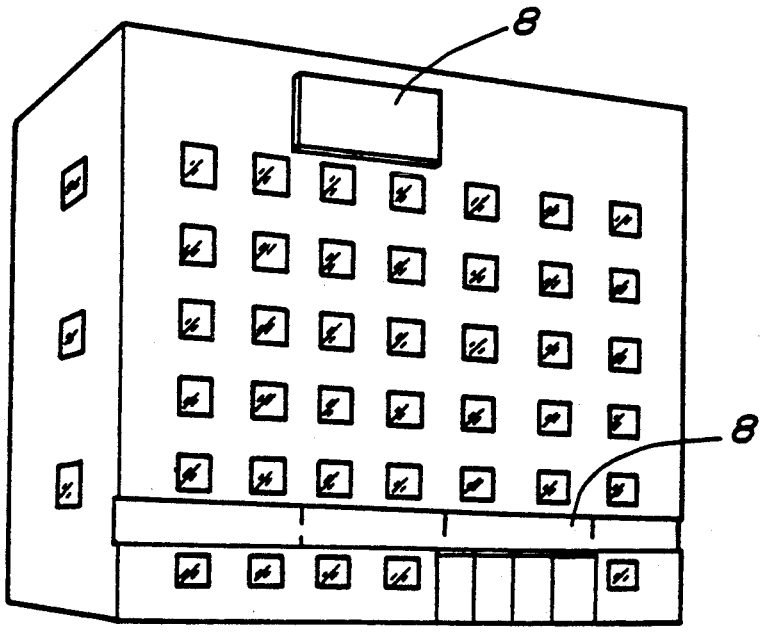
FIG. 29 is a perspective view showing an example in which the invention is used as an illumination apparatus for a wall surface of a building.

FIG. 29 shows an example in which the planar light-source device according to the invention is incorporated in an illumination apparatus which is mounted to a wall surface of a building. This example can widely be applied to wall-surface illumination apparatuses which are mounted, for example, to an outer wall surface or an inner wall surface of a building, or a wall surface of an underground market or an underground passage, and which is used as an illumination or an internal-illuminating c display.

In this example, the planar light-source device 8 according to the invention is mounted to the wall surface of the building. Since, however, the planar light-source device 8 having its construction as shown in FIG. 2 or FIG. 15 can be used as it is, the description of the planar light-source device 8 will be omitted. In this connection, in the case where establishment is the outdoor, such consideration or attention is required that the planar light-source device is brought to a waterproof construction or the like.

Figure 30:
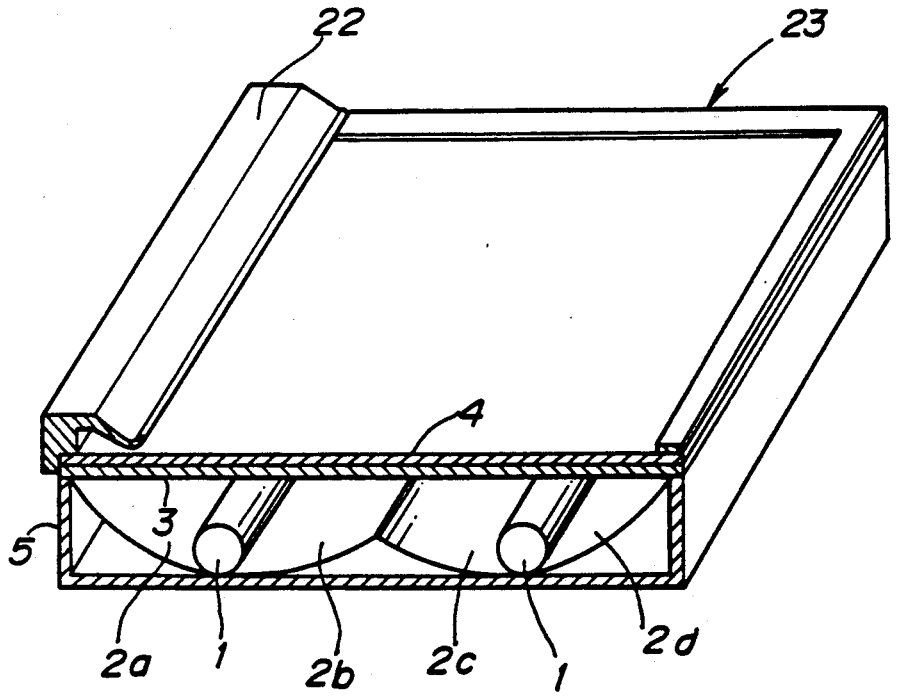

FIG. 30 shows an illumination apparatus such as a schaukasten or the like having incorporated therein the planar light-source device according to the invention. The illumination apparatus is not particularly different from that illustrated in FIG. 15 except that a frame 23 provided with a retainer 22 such as a film or the like is used.

Since the invention is constructed as described above, the invention has such advantages that the light from the light source is effectively utilized so that there can be provided the planar light-source device which is bright, high in uniformity, and capable of being sufficiently thinned. Further, the invention has such an advantage that there can be provided various illumination apparatuses each having incorporated therein the planar light-source device.

What is claimed is:

1. An illumination apparatus used for an internal-illumination type display device comprising a box-type housing provided with a display surface, a linear light source or a light source arranged linearly accommodated in said housing, a reflecting surface provided at a rear face of said light source, and a multi-prism sheet provided at an inner surface of said display surface, wherein said reflecting surface has such function that a major portion of a light reflected by said reflecting surface is obliquely incident upon said multi-prism sheet, wherein said multi-prism sheet has an inner surface formed with a group of prisms so arranged as to extend in parallel relation to the light source and having such function that the light incident directly or obliquely in reflection outgoes in concentration toward a predetermined direction, and a non-directionally diffusing dark-portion removing sheet for eliminating a dark portion at a location immediately above the light source, arranged on an outer surface of said multi-prism sheet.

2. An illumination apparatus for use with a box-type planar light-source device having incorporated therein a linear light source or a light source arranged linearly and provided, at its rear face, with a reflecting surface and, at its front face, with a multi-prism sheet, and a liquid-crystal display device for conducting a display in illumination with a liquid-crystal element mounted on the multi-prism sheet serving as a back light, characterized in that said reflecting surface of said planar light-source device has such function that a major portion of a light reflected by said reflecting surface is obliquely incident upon said multi-prism sheet, wherein said multi-prism sheet has its inner surface formed with a group of prisms so arranged as to extend in parallel relation to the light source and having such function that the light incident directly or obliquely in reflection outgoes in concentration toward a predetermined direction, and a non-directionally diffusing dark-portion removing sheet for eliminating a dark portion at a location immediately above the light source, arranged on an outer surface of said multi-prism sheet.

3. An illumination apparatus for use with an observation device such as a film or the like comprising a box-type housing, a linear light source or a light source arranged linearly accommodated in said housing, a reflecting surface provided at a rear face of said light source, and a multi-prism sheet provided at an inner surface of an observation surface of said housing, characterized in that said reflecting surface has such function that a major portion of a light reflected by said reflecting surface is obliquely incident upon said multi-prism sheet, wherein said multi-prism sheet has its inner surface formed with a group of prisms so arranged as to extend in parallel relation to the light source and having such function that the light incident directly or obliquely in reflection outgoes in concentration toward a predetermined direction, and a non-directionally diffusing dark-portion removing sheet for eliminating a dark portion at a location immediately above the light source, arranged on an outer surface of said multi-prism sheet.

* * * * *